US006224163B1

(12) United States Patent
Nies et al.

(10) Patent No.: US 6,224,163 B1
(45) Date of Patent: May 1, 2001

(54) MILLING ROLLER MODULE FOR A SURFACE MINER

(75) Inventors: Gerhard Nies, Meuro; Dieter Hoffmann, Leipzig; Volkmar Schrader, Schwarzheide; Thomas Stenzel, Hohenleipisch; Manfred John, Lauchhammer; Klaus Potenberg, Kleinkoschen; Hans-Joachim Schombel, Meuro; Bernd Glöckner, Elsterweda; Matthias Gnilke, Lauchhammer, all of (DE)

(73) Assignee: MAN TAKRAF Fodertechnik GmbH (DE)

( * ) Notice: Subject to any disclaimer, the term of this patent is extended or adjusted under 35 U.S.C. 154(b) by 0 days.

(21) Appl. No.: 09/390,400

(22) Filed: Sep. 3, 1999

(30) Foreign Application Priority Data

| | | |
|---|---|---|
| Sep. 5, 1998 | (DE) | 198 40 589 |
| Sep. 5, 1998 | (DE) | 198 40 599 |
| Apr. 14, 1999 | (DE) | 199 16 540 |
| Jun. 10, 1999 | (DE) | 199 26 357 |
| Jul. 9, 1999 | (DE) | 199 31 969 |

(51) Int. Cl.[7] ..... E01C 23/08; E01C 19/28
(52) U.S. Cl. ..... 299/39.2; 37/189
(58) Field of Search ..... 299/39.2, 39.4, 299/39.5, 39.6, 39.8; 37/189, 190

(56) References Cited

U.S. PATENT DOCUMENTS

| | | | | |
|---|---|---|---|---|
| 4,189,183 | * | 2/1980 | Borowski | 299/1 |
| 4,387,929 | * | 6/1983 | Wirtgen | 299/39.4 |
| 4,444,434 | * | 4/1984 | Gurries | 299/14 |
| 5,078,540 | * | 1/1992 | Jakob | 299/39.8 X |
| 5,722,789 | * | 3/1998 | Murray et al. | 299/39.4 X |
| 5,772,497 | * | 6/1998 | Dummermuth | 299/39.2 X |
| 5,983,533 | * | 11/1999 | Bitelli | 37/189 |

* cited by examiner

*Primary Examiner*—Frank S. Tsay
(74) *Attorney, Agent, or Firm*—McGlew & Tuttle, P.C.

(57) ABSTRACT

A milling roller module for a surface miner, includes a milling roller operating with undershot for loosening the material from the block being mined, a support frame for fastening the milling roller to the surface miner, and a takeup chute for supporting the intermediate conveying of the loosened material in the area of the milling roller and for transferring the material to the downstream discharge belt in a specific manner. The drives are placed into the milling roller and the feed lines are led into the milling roller together with the support frame for fastening the milling roller from the side in the upper third of the milling roller diameter. As a result, it is possible to perform mining operations up to a cutting depth that is equal to half the roller diameter. A takeup chute is provided to transfer the material from the milling roller onto the downstream discharge belt in a specific manner. This takeup chute is also used to limit the conveying space in the area of the milling roller together with ring segments arranged on it and on the milling roller and thus to reduce losses of material.

6 Claims, 9 Drawing Sheets

MILLING ROLLER MODULE FOR A SURFACE MINER

FIELD OF THE INVENTION

The present invention pertains to a milling roller module for a surface miner, comprising a milling roller for loosening the material from the block being mined, a support frame for fastening the milling roller to the surface miner, and a feed chute for supporting the intermediate conveying of the loosened material in the area of the milling roller and to transfer the material in a specific manner to the downstream discharge belt. Cutting heights on the order of magnitude of up to half the diameter of the milling roller shall be able to be reached with the milling roller module. The present invention is suitable for use in surface miners with milling rollers operating with an undershot, i.e., the direction of rotation of the milling roller on the side of the block being mined is from top to bottom.

BACKGROUND OF THE INVENTION

In surface miners with milling rollers operating with an undershot of the above-described type, the material is loosened by the milling tools from the ground over a determined cutting depth over the entire width, carried in the direction of rotation, loosened material is guided on the outside by helically arranged guide elements in the direction of the middle of the miner, and it is then thrown onto a discharge belt, which is narrower than the width of the milling roller. The smallest possible losses shall occur during the pickup of the material and the intermediate conveying of the material. The feed movement is brought about by the traveling of the miner in the direction of mining. Surface miners with milling rollers operating with an undershot offer the advantage over surface miners with milling rollers operating with an overshot that only a small amount of dust is generated and no excessively large chunks are loosened from the ground and picked up or pushed off laterally. The maximum attainable cutting depth depends on both the roller diameter and the mounting of the milling roller and its arrangement on the surface miner.

Prior-art surface miners of the above-described type are designed such that the roller-shaped mining member engages the material to be mined with up to about one third of its diameter. This limited cutting height is due to the fact that certain assembly units for the mining member, such as the mounting of the milling roller and its drives and the drive transmission elements, e.g., the chain and the sprocket wheel, are arranged on both sides next to the roller body and a collision would therefore occur with the beds (blocks to be mined) that have not yet been stripped on the side. Such engagement ratios of the roller-shaped mining members to the material to be mined have been known in a first group of surface miners as they are disclosed in the patent specifications DE 35 04 610 C2 and DE 36 42 809 C2. The milling rollers have the same diameter over their entire length. The milling rollers are mounted by means of axle bearings on both sides.

In order for the material to be able to reach the narrower discharge belt from the milling roller, the milling tools and continuous guide plates are arranged in helical lines directed from the outside to the inside, on the one hand, and, on the other hand, they are arranged in front of the discharge belt in the direction of the material transfer in order to convey the material loosened in the outer areas at right angles in the direction of the middle area defined by the discharge belt and then to correct its flight parabola in the direction of the discharge belt if necessary. This flight parabola changes with the speed of rotation of the milling roller.

A second prior-art group of surface miners driven according to this principle is disclosed in the prospectus "Easi-Miner®, Model 1224, Continuous Surface Miner" of the firm of Huron, U.S.A and in the patent specifications U.S. Pat. No. 4,536,037 and U.S. Pat. No. 4,690,461. The basic body of the milling roller has the same diameter over its entire length. The milling tools and the guide plates are arranged in helical lines on the circumference of the milling roller. Due to the material being guided from the outer areas to the middle area, the amount of material increases from the outside toward the middle. However, since the milling roller has the same diameter over its entire length, the space between the jacket of the milling roller and the cutting circle diameter is utilized increasingly less to the outside. This is disadvantageous because lower stability is reached, in principle, at equal wall thickness in the case of smaller roller diameters and to obtain a sufficiently large space in the middle of the milling roller for picking up and forwarding the material being conveyed, the milling tools must be made correspondingly long to obtain a sufficiently large cutting circle diameter. The milling roller is mounted on both sides. The drive is transmitted on one side from the outside from a motor arranged above via a chain drive to the milling roller. To make it possible to reliably transfer the material from the milling roller onto the discharge belt, a chute with a broad takeup opening is provided here as well, and this chute narrows in the direction of the discharging belt and thus corrects the flight parabola of the material into the direction of the discharge belt in the case of deviations. The flight parabola of the material also changes with the speed of rotation of the milling roller.

The above-mentioned two types of miners are designed preferably for hard material, which is picked up by the miner after the milling process and is loaded on trucks traveling along. With miners of such a design for mining deposits according to the surface mining process, an increase in the mining performance is achieved after the maximum cutting height has been reached by increasing the feed speed of the miner. The drawbacks of increased chassis wear and energy consumption, which is due to the faster movement of the entire miner, are thus accepted. Furthermore, the connection of the miner to a belt system for continuous mining is possible with difficulty only at these high velocities of travel. If this type of surface miner were used to mine material in greater cutting depths, it would be necessary to provide means that prevent the loosened material from being pushed off to the side from the area of the milling roller.

Another surface miner with a milling roller designed as a roller-shaped mining member, which can operate in a cutting height that is approximately equal to half the diameter of the mining member has been known from the patent specification U.S. Pat. No. 5,092,659. Since the bearings for the milling roller are located within the basic body of the milling roller, this cutting height can still be increased somewhat even in the case of optimization of the drives arranged on the outside above on both sides of the milling drum. However, the arrangement of the drives next to the milling roller requires special measures for protection against harmful mechanical effects. The milling roller operates with an overshot. The cut material is carried to the upper area of the milling roller, from which it falls into the interior through the grid-like jacket of the roller as a consequence of its gravity. A cross belt with a chute is arranged there, from which the material is carried to the outside by a cross belt and is transferred onto a conveyor belt conveying it farther away.

To have sufficient space for this, a block must already have been mined on this material discharge side. A specific mining technology must therefore always be used with such a miner.

To ensure that the loosened material will also fall reliably into the interior through the grid-like jacket of the roller, a maximum speed of rotation must not be exceeded. Furthermore, moist and clayey soils adversely affect the maximum possible output of the miner.

Furthermore, a surface miner similar to that described above has been known from the patent specification U.S. Pat. No. 5,730,501. The material having fallen through the grid structure of the basic body of the milling roller as according to the above-described prior-art solution is discharged by the cross belt from the interior of the milling roller, transferred to a vertical lifting screw, which assumes the function of an intermediate conveyor, and is passed on by this to a removing conveyor. In order to have sufficient freedom of movement for the lifting screw in the mining area during the feed movement of the miner, an additional milling roller is arranged rotatably in a vertical axis of rotation at the lower end of the lifting screw. The maximum cutting height of the main milling roller is thus limited by the cutting height of the smaller milling roller that is additionally needed.

What was said above applies to the limited output and the disadvantageous effect in the case of moist and clayey soils.

A surface miner, in which a roller-shaped mining member operating with overshot comprises four bucket wheels arranged in a common axis and being arranged in front of the miner in the direction of travel, is described under 4 in the DE journal *Braunkohle,* 1990, No. 3, pp. 28 to 34. These bucket wheels are fastened to the miner by two brackets, which are arranged each between the outer and middle bucket wheels. Due to the drives being accommodated in the interior of the bucket wheels and due to the feed lines for these drives being displaced into the free space together with the brackets between two adjacent bucket wheels, the necessary freedom of movement is achieved on the side of the mining member. A mining member thus designed requires more material for its manufacture and is therefore heavier than the above-described ones. However, cutting heights that are greater than the radius of the mining member can be reached with this mining member. However, the consequence of the overshot mode of operation of the mining member is that chunks that cannot be picked up by the miner can be picked up and dust is generated. Material loosened in the outer areas of the pickup member is partially pushed off to the outside and forms piles there over the entire length next to the mining section. To prevent loosened material being conveyed from penetrating via the intermediate spaces into the interior of the mining member and from adversely affecting the mining process and/or from leading to an additional wear of moving parts, special precautionary technical measures are taken to retain the material being conveyed. The brackets between the bucket wheels do not make it possible to provide a transverse conveying of the material directed toward the middle in the area of the mining member. As a result, additional cross belts are needed behind the roller.

SUMMARY AND OBJECTS OF THE INVENTION

The basic object of the present invention is therefore to design the milling roller module such that it is sufficiently stable and is suitable for robust use-of the surface miner with high output. To achieve this, the milling roller shall be able to be engaged with the material to be mined over its entire cutting width with a cutting height on the order of magnitude of up to its half cutting circle diameter and thus to perform mining work without elements of the drive colliding with the cutting edge on the side. Favorable dynamic conditions shall be present during the pickup of the material and the passing on of the material from the milling roller to the removing belt under different conditions in terms of cutting depth, speed of rotation of the milling roller, the feed speed of the miner and the properties of the material, and the smallest possible loss of material shall occur.

According to the invention, a milling roller module for a surface miner is provided with a milling roller operating with undershot, drives for the milling roller, material guiding elements arranged between the milling roller and the downstream discharge belt, and a fastening of the milling roller to the surface miner. The milling roller is arranged in front of the chassis at right angles to the direction of travel in its horizontal longitudinal axis. The horizontal longitudinal axis is also its axis of rotation. The milling roller is mounted and driven on both sides in the area of its end faces, with milling tools and guide plates are arranged on its circumferential surface. The material being loosened from the block being mined is carried in the direction of rotation and is then transferred to a discharge belt, which is narrower than the cutting width of the milling roller. The conveying space of the loosened material in the area of the milling roller is the annular space between the milling roller jacket and the cutting circuit diameter ($D_S$). The basic body of the milling roller is a milling roller jacket and it completely accommodates a drive each on both sides and the power takeoff shafts of the drives are connected to the milling roller and the fixed drive housing is connected to the support frame, and the bearings of the drives are also the bearings of the milling roller. A takeup chute, which surrounds the milling roller at a spaced location from its cutting circle diameter ($D_S$) from the top edge of the level is cut in the direction of rotation of the roller in an angle of about 110° and thus limits the conveying space for the loosened material to the outside and is provided with a guide tunnel in the area of the intended transfer of the material to the discharge belt. This is provided downstream of the block being mined in the direction of rotation of the milling roller to guide the material and to transfer it to the downstream discharge belt in a specific manner. The takeup chute is connected to the surface miner in one upper joint and two longitudinally adjustable struts.

Two drives are arranged symmetrically on both sides of the milling roller directly in its interior and fastened with their fixed part to the support frame, on the one hand, and connected to the flanges of the jacket of the milling roller coaxially to its rotating part, on the other hand. The bearings between the fixed and rotating drive parts are made so stable that they are also bearings for the milling roller. To obtain different roller speeds, the motors of the drives are provided with transmissions. The takeup chute is arranged between the milling roller and the removing belt arranged downstream in the direction of conveying in order to ensure reliable conveying of the material in the area of the milling roller and the transfer of the material to the removing belt under different operating conditions and for different material properties.

To have sufficient space in the interior of the milling roller for the drives and to have sufficient conveying space outside between the cutting circle diameter of the milling tools and the jacket of the milling roller in the case of the amount of material increasing from the two outer areas toward the middle area as a consequence of transverse conveying of the loosened material, the diameter of the middle area of the milling roller jacket is made smaller than the two outer areas. The two transitions between different diameters of the milling roller jacket are made oblique. As a result, a basic body is obtained that can be manufactured under favorable technological conditions and has high stability, and in which the pickup and conveying space for the material to be conveyed is adapted to the actual amount of material to be conveyed.

A support frame is provided for fastening the milling roller to the surface miner. It comprises a horizontal middle beam connected to the superstructure of the surface miner and a right and left side member each arranged on both sides. The lower, free ends of the two side members are annular and, being supports of the fixed flanges of the drives, they can be connected to these flanges by means of bolts. The side members are bent at the bottom such that they extend from the outside laterally into the milling roller body. This introduction is done in the upper area, so that mining operation can be performed in blocks of at least a height corresponding to half the cutting circle diameter of the milling roller. The feed lines for the drives are led from the drive container within the protective profile of the support frame.

Due to the bilateral mounting and drive of the milling roller, favorable conditions are created for the design as well as the static and dynamic conditions. The clearly structured arrangement of the drives makes simple maintenance and repair possible. The encapsulated design of the drives offers a high level of protection from dust and mechanical effects from the outside. On each of the two sides of the milling roller, the inner bearing of the power take-off is also used to mount the milling roller at the same time. The connection of the milling roller to the surface miner by the support frame represents a simple solution, in which all mounting points are freely accessible.

Thus, controllable hydraulic motors, electric motors or other motors of a compact design with gears may be used as drives. The only condition is that the power take-off shaft of each drive be arranged on the axis of the milling roller and be connected to the milling roller via suitable machine parts.

The milling roller is equipped with milling tools and guide plates depending on the intended performance parameters and the existing conditions of use. The milling roller is thus adapted to the required block size and to the physical characteristics of the materials to be mined, such as hardness, brittleness, stickiness, etc. It must be ensured at the same time that the chunks of the loosened material are smaller than the available annular conveying space of the milling roller, which is limited by the milling roller jacket on the inside and by the cutting circle diameter on the outside, because disturbances could otherwise occur in the flow of material and consequently in the mining process. To prevent loosened material, especially material loosened by the free-cutting bits, from falling out of the annular conveying space of the milling roller laterally in the outer areas, closing rings consisting of segments are provided on the two outer edges and closing ring segments are provided in the edge areas of the takeup chute.

The cutting upward of chunks and the nuisance caused by dust generation are avoided by the undershot cutting direction of the milling roller.

Further details and advantages of the subject of the present invention appear from the following description and the corresponding drawings, in which a preferred exemplary embodiment is shown with the necessary details.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
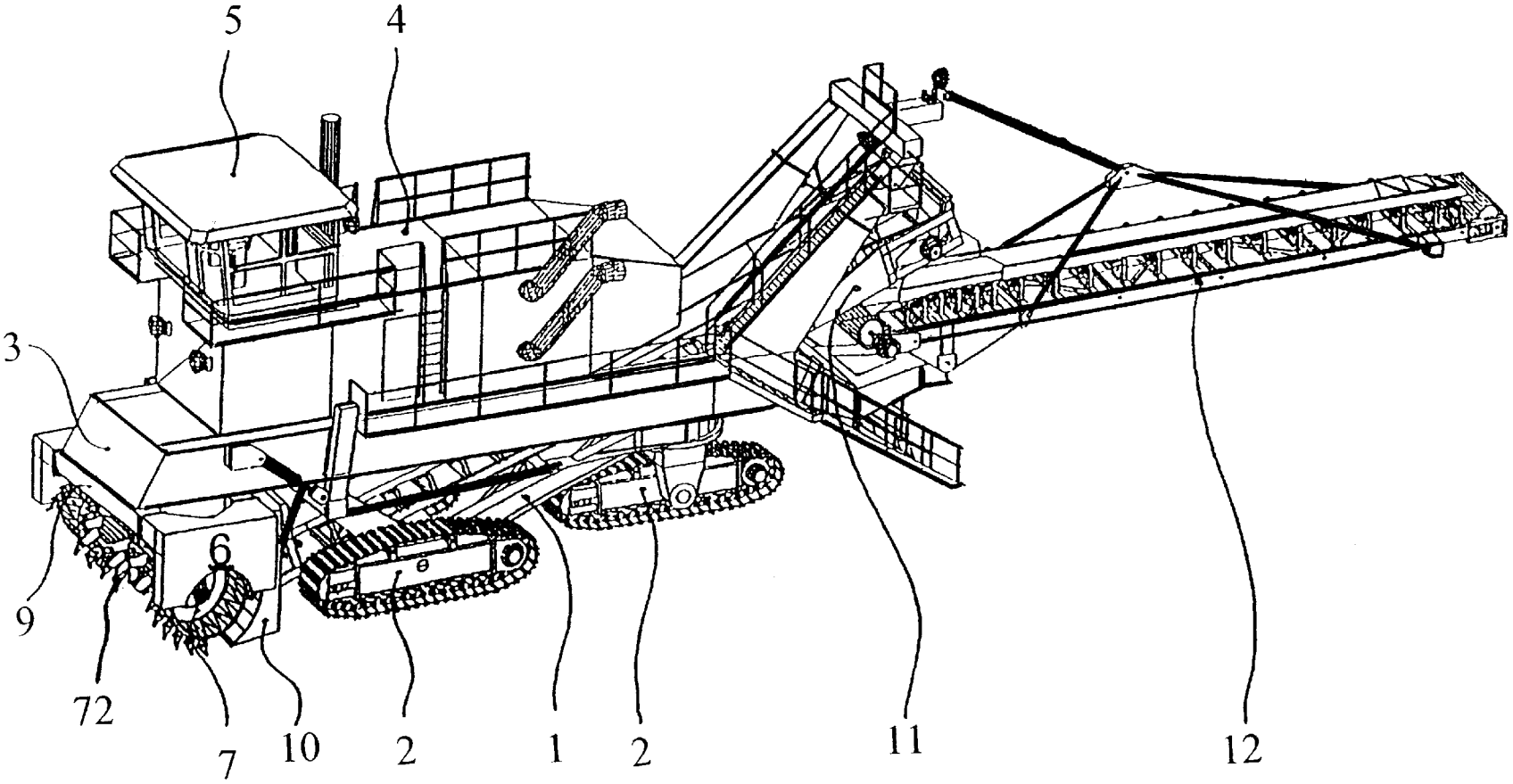
FIG. 1 is a perspective view of a surface miner with a milling roller operating with undershot direction of rotation.

Referring to the drawings and in particular to FIG. 1, the surface miner according to the invention comprises the principal assembly units substructure 1 with the chassis 2, the superstructure 3 and the drive container 4 arranged thereon, as well as the attached driver stand 5. Furthermore, the milling roller module 6, comprising the milling roller 7 with the drives 8, the support frame 9 and the takeup chute 10, are located in front of the chassis 2 in the direction of mining. The discharge belt 11, conveying away from the milling roller 7, is led obliquely upward through the superstructure 3. The pivotable loading boom 12 is arranged downstream of the discharge belt in the direction of conveying at the rear end of the superstructure 3.

The milling roller 7 operates with undershot and is fastened to the support frame 8 on both sides. The feed movement is brought about by the traveling of the device in the direction of mining. The milling roller 7 is directed with its milling tools 72 toward the block to be mined. The material is loosened from the block being mined over the entire width of the milling roller 7, carried in the direction of rotation, conveyed in the process in the direction of the middle of the miner by guide elements to be described in detail below, guided by means of the takeup chute 10 in the area outside the block being mined, and specifically transferred to the discharge belt 11. The material is passed on from the discharge belt 11 onto the pivotable loading boom 12 and is transferred either intermittently into trucks or continuously to a belt system via a face conveyor.

Figure 2:
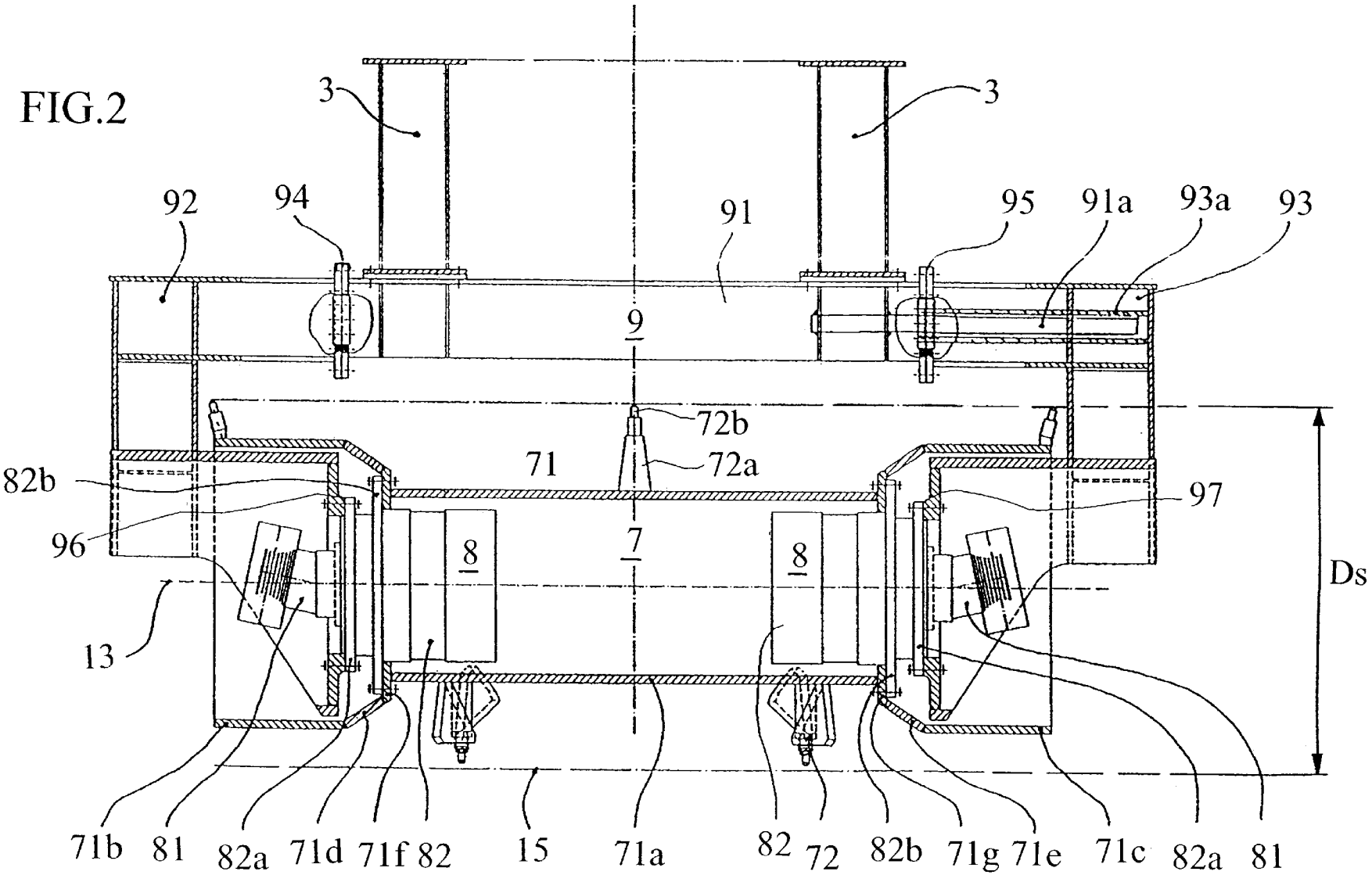
FIG. 2 is the longitudinal section of the milling roller module.

According to FIG. 2, the milling roller 7 is fastened to the superstructure 3 by the support frame 9. The support frame 9 comprises a horizontal middle beam 91 and a twice bent, right and left side member 92 and 93 each. Each of the two side members 92 and 93 is bolted to the middle beam 91 in a vertical joint 94 and 95, respectively, and centered. The basic body of the milling roller 7 is the milling roller jacket 71. It has a tubular design and comprises a broad, middle pipe 71*a* having a defined diameter $D_1$ and two narrower, outer pipes 71*b* and 71*c* having a larger diameter $D_2$, which are arranged to the right and left thereof. A flange 71*f* and 71*g* each is arranged at both ends of the middle pipe 71*a* on each of its two end faces. Oblique transitions 71*d* and 71*e* in the form of the jacket of a truncated cone are arranged between the outer edge of each of the two flanges 71*f* and 71*g* and the two outer pipes 71*b* and 71*c*. These individual parts 71*a* through 71*g* of the milling roller jacket 71 are welded to one another and thus form a stable basic structure.

The basic design of the milling roller 7 provides for a bilateral, symmetrical arrangement of the bearings and drives 8 and thus for a favorable flow of forces distributed uniformly between the two sides. Furthermore, provisions are made for the bearings of the drives 8 between the fixed and rotating drive parts being also the bearings for the milling roller 7. The drives 8 are accommodated centrally in the milling roller jacket 71 in their two outer areas having a larger diameter $D_2$ in their longitudinal axis 13, which is also their axis of rotation. The two drives 8 are of an encapsulated design and comprise a hydraulic motor 81 and a transmission unit 82 each.

Figure 3:
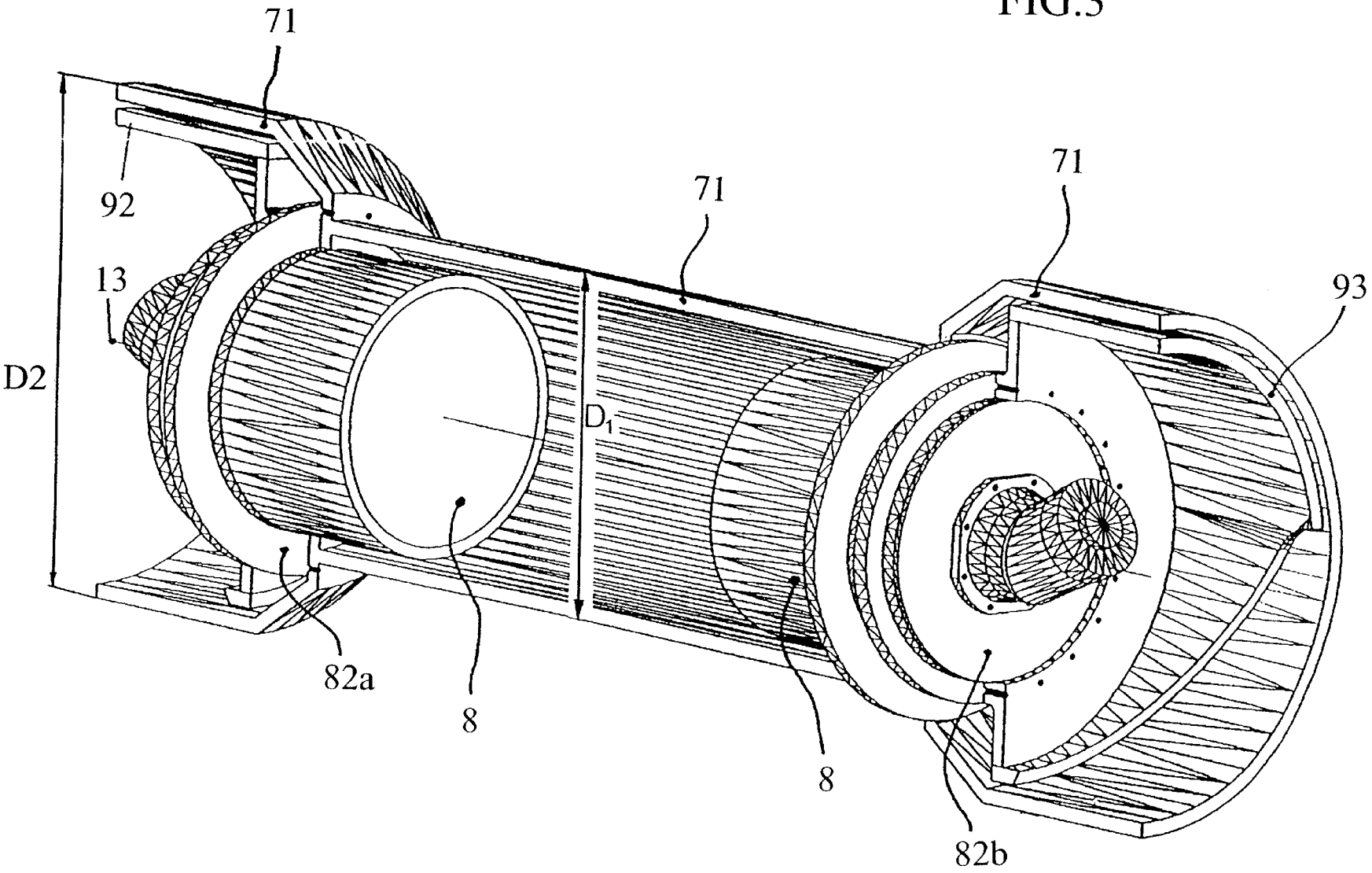
FIG. 3 is a partially cutaway perspective view of the milling roller with a special design of the support frame in this area.

The drive 8 is provided with a first flange 82*a* on its fixed side and with a second flange 82*b* on the side of its power take-off shaft. Each of the two flanges 82*a* of the fixed transmission part is connected to the support frame 9 leading to the superstructure 3. The two free ends of the side members 92 and 93 are likewise provided with flanges 96 for this purpose. The outer shape of the side members 92 and 93 is designed in the area of the milling roller jacket 71 such that, having a high rigidity, they extend laterally from the top into the milling roller jacket 71 on both sides, without hindering the rotary movement. The design of the two parts of the side members 92 and 93 of the support frame 9, which is especially a annular design, is shown in FIG. 3.

The fixed, nonrotating flanges 82*a* of the two drives 8 are bolted to the respective flange 96 and 97 of the support frame 9 and the flanges 82*b* of the output shaft are bolted to the flanges 71*f* and 71*g* belonging to the milling roller jacket 14. The milling roller drives 8 are thus in contact by their flanges 82*b* with the flanges 71*f* and 71*g* of the milling roller module 6 and extend with the majority of their transmission unit 82 into the interior of the middle pipe 71*a* of the milling roller jacket 71 through the respective flanges 71*f* and 71*g*. Due to the fact that the external diameter of the two flanges 71*f* and 71*g* is greater than the external diameter $D_1$ of the middle pipe 71*a*, the drives 8 can be bolted to the milling roller 7 from the outside without any obstacle for the mechanic. A rapid and problem-free fastening and loosening of the two drives 8 is thus possible. The entire assembly and disassembly of the drives 8 is facilitated even more by the fact that the two side members 92 and 93 of the support frame 9 can be unbolted from the horizontal middle beam 91. A joint 94 and 95 each with centering means is provided for this purpose between the two side members 92 and 93 and the horizontal middle beam 91. To make it possible to pull off the side members 92 and 93 from the middle beam 91 in a simple manner during disassembly, guide pipes 91*a* and 91*b*, which extend into the area of the two side members 92 and 93 and are surrounded by sliding pipes 92*a* and 93*a* fastened in the side members 92 and 93 in the area of the two side members 92 and 93, are arranged in the middle beam 91. In the representation according to FIG. 2, this assembly aid is shown only on one side, and the second guide on the other side is not shown for the sake of greater clarity. As soon as the screw connections are separated from these two side members 92 and 93, the side members 92 and 93 can be readily pulled away from the middle beam 91 together with the drive 8 through this guide.

The interior of the basic body of the milling roller 7 is completely closed to the outside and thus protected due to the arrangement of the drives 22. Due to the drives 8 being arranged within the milling roller 7, no additional power transmission elements, such as chains or the like, are necessary between the drives 8 and the milling roller 7. Since the bearings of the drives 8 are also the bearings of the milling roller 7, no additional milling roller bearings are needed, either.

Since the milling roller jacket 71 is laterally open up to the drives 8 in the area of its two outer pipes 71*b* and 71*c* and loosened material can thus enter the interior of these two pipes 71*b* and 71*c*, deflecting means, which greatly reduce the penetration of material and deflect material having penetrated and guide it in the outward direction, are arranged in this area at the two ends of the side members 92 and 93.

The conveying space for the loosened material of the milling roller 7 is the annular space between the milling roller jacket 71 and the cutting circle diameter $D_S$. By enlarging this space from the outside toward the center, a solution adapted to the actual amount of material to be conveyed is obtained. A sliding transition, which can be achieved in a technologically favorable manner and brings about a favorable flow of material, is created between the areas having different diameters $D_1$ and $D_2$ by means of the two oblique transitions 71*d* and 71*e*.

The outfitting of the milling roller 7 with milling tools and material guide means in conjunction with the takeup chute is decisive for the loosening of the material from the block being mined, for passing it on in the area of the milling roller 7 and for transferring the material to the discharge belt 11 in a specific manner.

Figure 4:
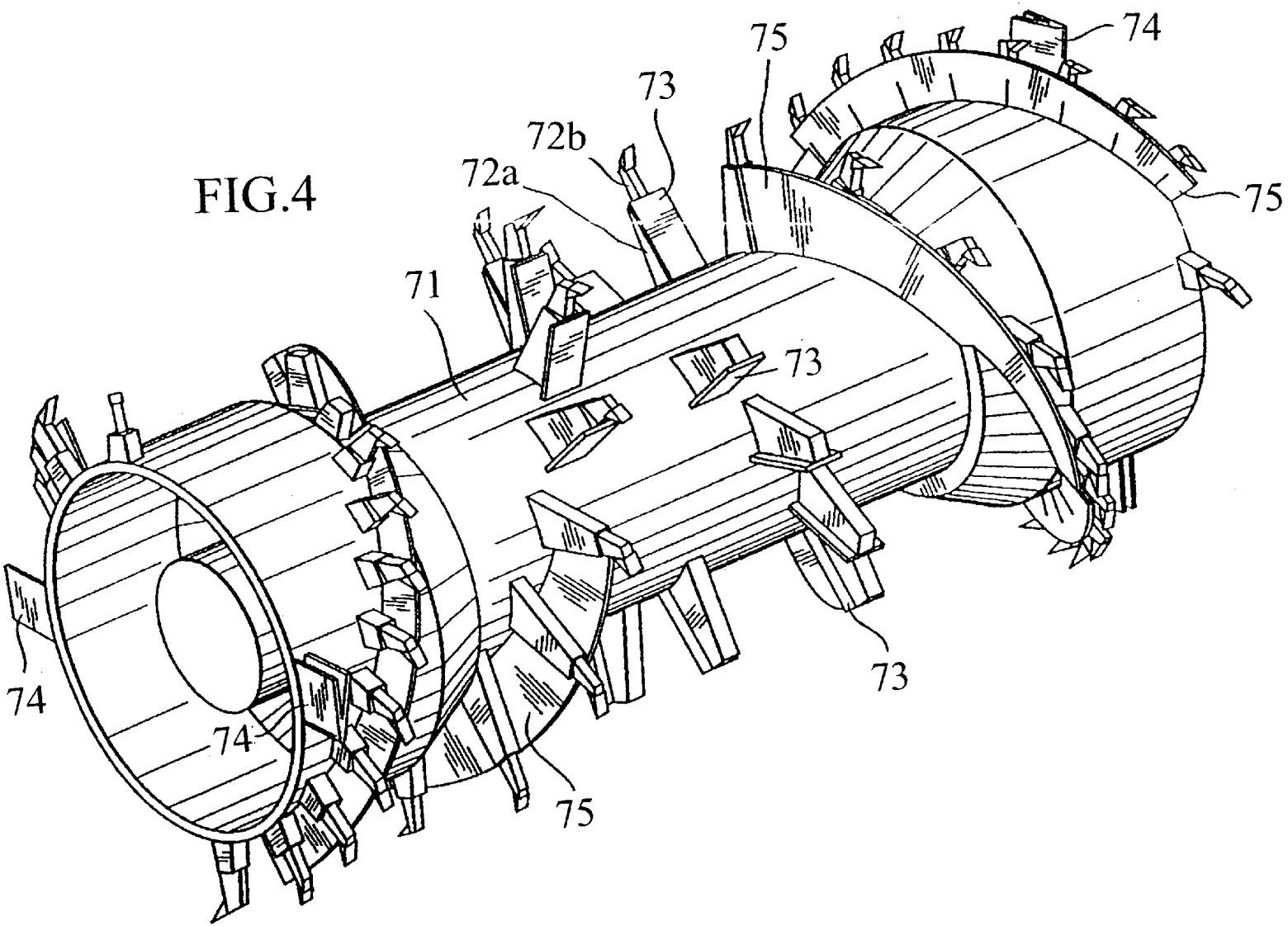
FIG. 4 is a perspective view of the milling roller.
Figure 5:
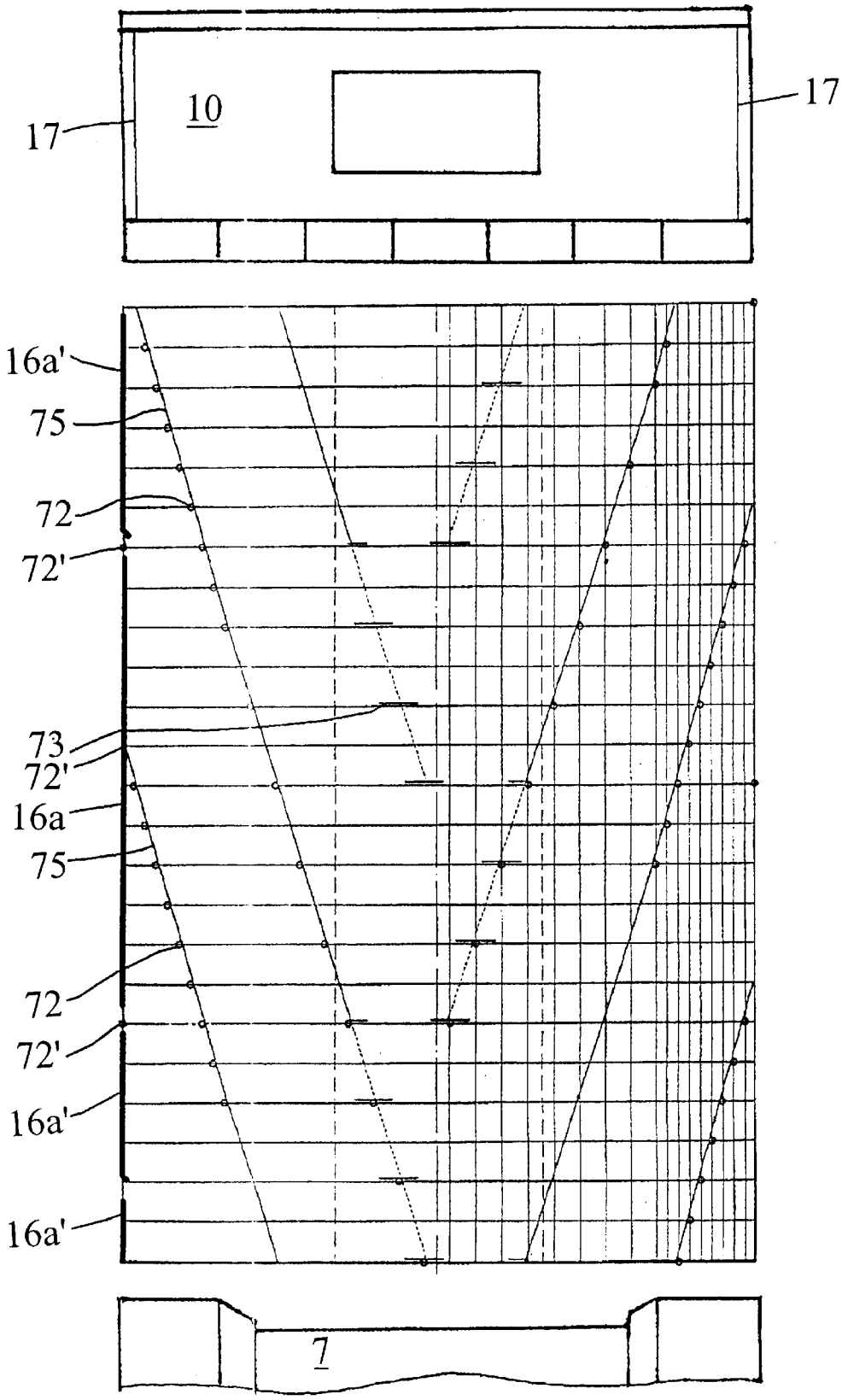
FIG. 5 is the layout of the milling roller jacket with the arrangement of the milling tools and of the means for guiding the material to be conveyed.

In a variant for a material of low hardness and strength, e.g., brown coal, the outfitting of the milling roller 7 with milling tools 72, ejection plates 73 as well as lateral and helical guide plates 74 and 75 is shown in a perspective view in FIG. 4 and schematically as a layout on the milling roller jacket 71 in FIG. 5. The milling tools 72, comprising the welded-on milling bit holders 72*a* and the interchangeable milling bits 72*b*, are arranged on the circumference of the milling roller jacket 71. The cutting edges of the milling bits 72*b* are adapted to a common cutting circle diameter $D_S$. To make it possible to use milling bits 72*b* of equal size when outfitting a milling roller, the bit holders 72*a* also have different sizes because of the different diameters $D_1$ and $D_2$ and thus they compensate differences. The outfitting of the milling roller 7 on the milling roller jacket 71 with milling tools 72 depend essentially on the specific conditions of use, the configuration of the miner, the intended output, and the particle size in which the material is to be mined. This applies especially to the type of the milling bits 72*b*, their number and their arrangement in relation to one another in helical lines, and the pitch angle of these helical lines is also optimized according to the properties of the material to be mined. The mining tools 72 are arranged on the circumference of the milling roller 7 one behind the other in the direction of rotation in one helical line or in a plurality of helical lines extending to the center, symmetrically or offset in relation to one another. The symmetrical arrangement of the helical lines may be used if the milling bits 72*b* are positioned at relatively closely and uniformly spaced locations from one another. In contrast, the offset arrangement shown is to be preferred in the case of the use of few milling bits 72*b* positioned at more widely spaced locations from one another in order to minimize the dynamics during milling. This means that smooth run of the milling roller 7 can be achieved by a few milling bits 72*b*, whose number is, however, always nearly equal. Since the milling roller 7 is to be provided for mining brown coal here and special requirements are imposed on the chunk size of this brown coal, the milling bits 72*b* must be arranged at relatively widely spaced locations from one another. However, since the space for the material to be mined is smaller in the two lateral areas than in the middle area as a consequence of the stepping of the circumference of the roller, and even though this is sufficient for a smaller amount of material being mined, problems may arise in the case of larger chunks in the annular space between the stepped milling roller jacket 71 and the cutting circle diameter $D_S$. This is avoided by deliberately producing smaller chunks in the two outer areas. The milling bits 72*b* are therefore arranged at more closely spaced locations in relation to one another there than in the middle area. They are arranged in two helical lines on the outside, whereas only one of these extended helical lines is equipped with milling bits 72*b* in the middle area. The guide plates 75 are replaced with ejection plates 73 arranged behind the milling bits 72*b* in the middle area of the drum, as a result of which the transfer of the material being conveyed to the discharge belt 11 will be distributed uniformly. Since the second helical line is not equipped with milling bits 72*b* in the middle area of the drum in order to obtain larger chunks, it is equipped with ejection plates 73 only. The helical lines were arranged offset by 90° in relation to one another in order to avoid the impacts of the milling roller 7 during the mining process due to the milling bits 72*b* arranged at more widely spaced locations from one another during the mining process and to make the transfer of the material being conveyed onto the discharge belt 11 more continuous. The milling tools 72' arranged on the two outer edges of the milling roller 7 have the additional task of creating the free cut needed laterally in order to avoid jamming of the milling roller 7. The same milling bits 72*b* that are also used on the entire milling roller jacket 71 may be used for this, and the milling bit holders 72*a* only need to be designed and fastened such that the cutting edges of the milling bits 72*b* will point obliquely to the outside.

To make it possible to transfer the loosened material from the milling roller 7 to the downstream discharge belt 11 in a specific manner and without loss, the takeup chute 10 belonging to the milling roller module 6 is provided. Three tasks are to be accomplished with it:

- The conveying space following the block being mined shall be limited and the conveying of the material in the direction of rotation as well as in the axial direction shall be supported;
- the material transfer site to the discharge belt 11 shall be accurately limited locally;
- elimination of the unevennesses (leveling) of the level 15 being cut, which is also the traveling plane of the miner, and pickup of excess material with support of the milling roller 7 shall be possible.

Figure 6:
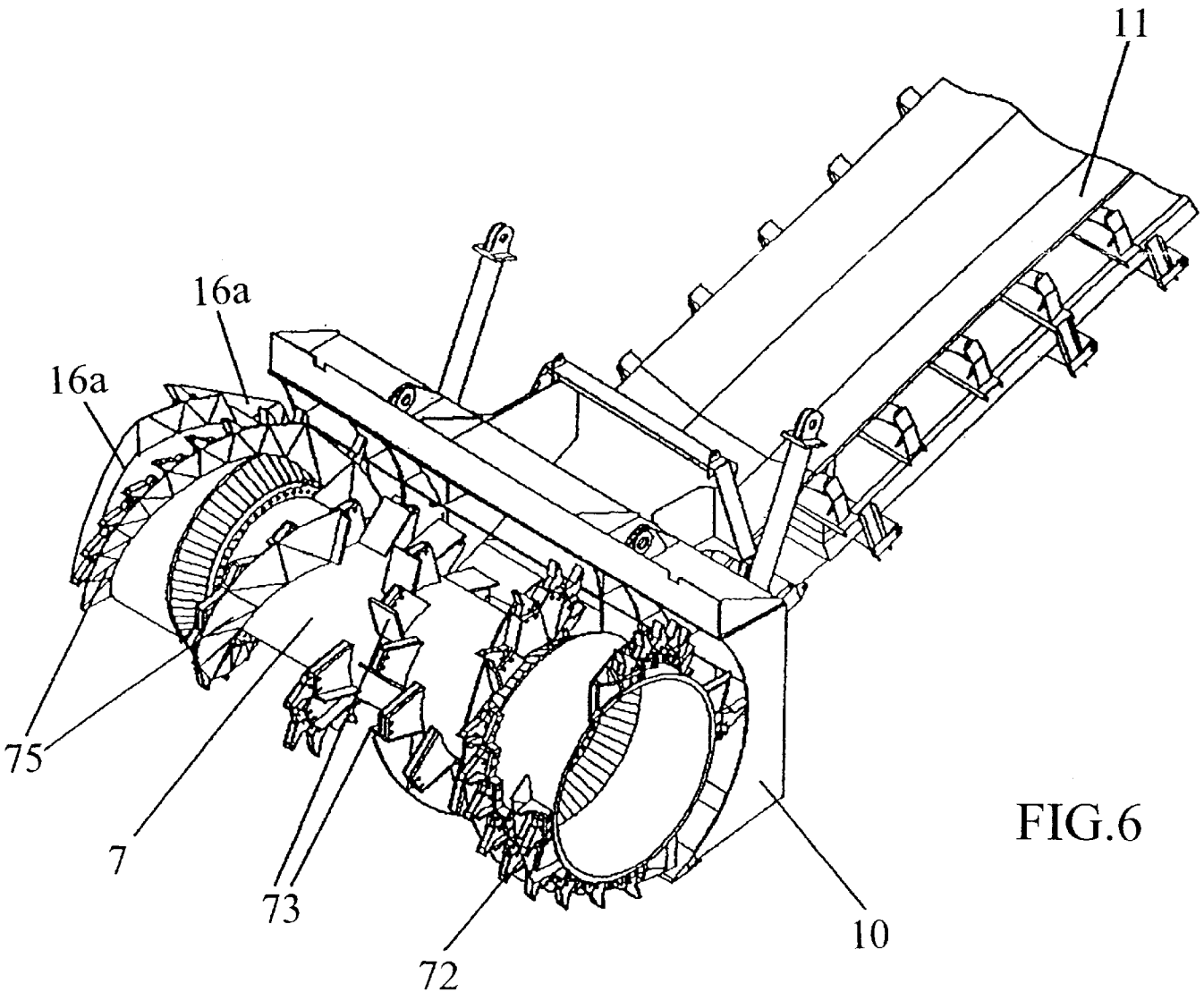
FIG. 6 is a perspective view of the assembly units milling roller, takeup chute and the discharge belt.
Figure 7:
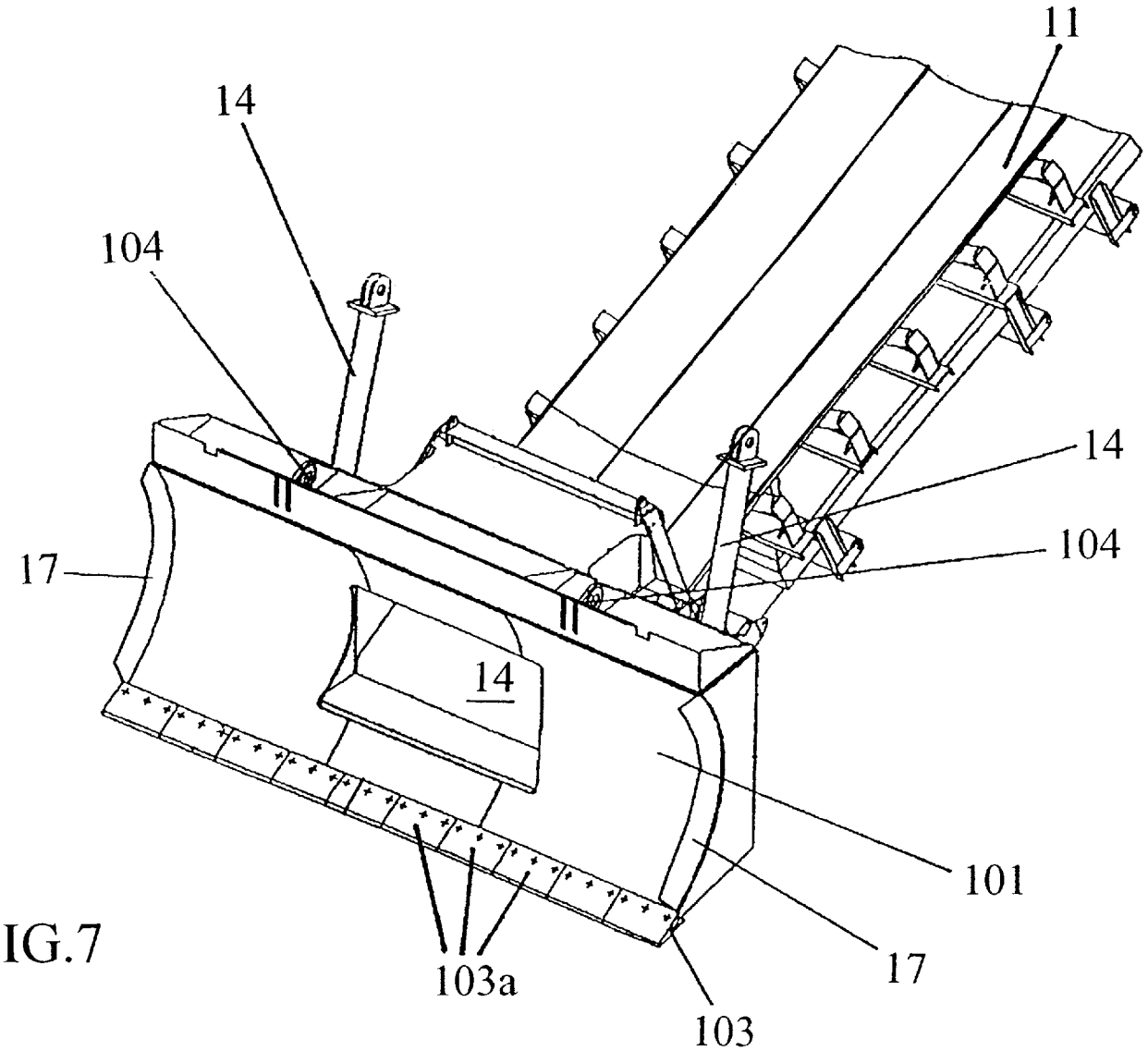
FIG. 7 a perspective view of the takeup chute with the downstream discharge belt.

In order for the takeup chute 10 to be able to accomplish these three tasks, it has a stable design and is provided with a transfer opening. FIG. 6 shows the arrangement of the takeup chute 10 between the milling roller 7 and the discharge belt 11. According to FIG. 7, it comprises the arc-shaped shield 101. The shield surrounds the milling roller 7 over its entire width. Its height extends from the top edge of the level being cut, which is also the traveling plane of the miner, to a height that corresponds to about ¾ of the diameter of the milling roller 7, at a certain distance from its cutting circle diameter $D_S$. The shield 101 thus surrounds the milling roller 7 on the side of the miner at an angle of about 110°. An opening, which is, in principle, rectangular, is provided in this shield 101 in the area in front of the discharge belt 11 for the guide tunnel 102 for the transfer of the material from the milling roller 7 to this discharge belt 11. The opening is about 20% narrower than the discharge belt 11 in order to achieve reliable transfer of the material and to avoid loss of material during conveying. For longer life, the shield 101 is provided with interchangeable wear plates, interchangeable plastic linings or with a plastic coating. The shield 101 is equipped in the lower area with a stable wear edge 103, comprising segments 103*a*, which may be replaced when a certain degree of wear has been reached.

The shield 101 is assembled by means of ribs and side plates to form a stable welded structure. To show this, the takeup chute 10 is shown without its shield 101 in the representation in FIG. 6. The takeup chute 10 thus assembled is connected directly to the superstructure 3 of the surface miner above in the two rings 104 by means of bolts and it is connected indirectly to the superstructure 3 of the surface miner below by the two struts 14. Each of the two struts 14 is connected to the superstructure 3 on one of its sides and to the takeup chute 10 on its other side by means of pin joints. Both struts 14 are made longitudinally adjustable. The change in length is brought about by the arrangement of different adapters/shims at an articulation point or by means of two-part struts, which are connected by means of an adjustable and lockable threaded piece, or by means of a hydraulic cylinder, which is mechanically blocked after the adjustment. As a result, the annular gap between the cutting circle of the milling roller 7 and the takeup chute 10 can be changed, and the distance between the wear edge 103 and the cutting surface/level can be corrected in the case of wear of the milling tools 72. The takeup chute 10 is now pivoted around the upper joint, by which it is connected to the superstructure 3 of the surface miner. If the two pins of the upper joint are made eccentric, differences in the gap between the cutting circle diameter $D_S$ of the milling tools 9 and the shield 101 or the wear edge 103 of the shield 101 and the level can be compensated. By using adjusting members, the eccentric pins can be automatically adjusted. For maintenance and repair work on the takeup chute 10, its rear suspension can be detached in a simple manner and then pivoted off from the milling roller 7 by means of a jack.

Figure 8:
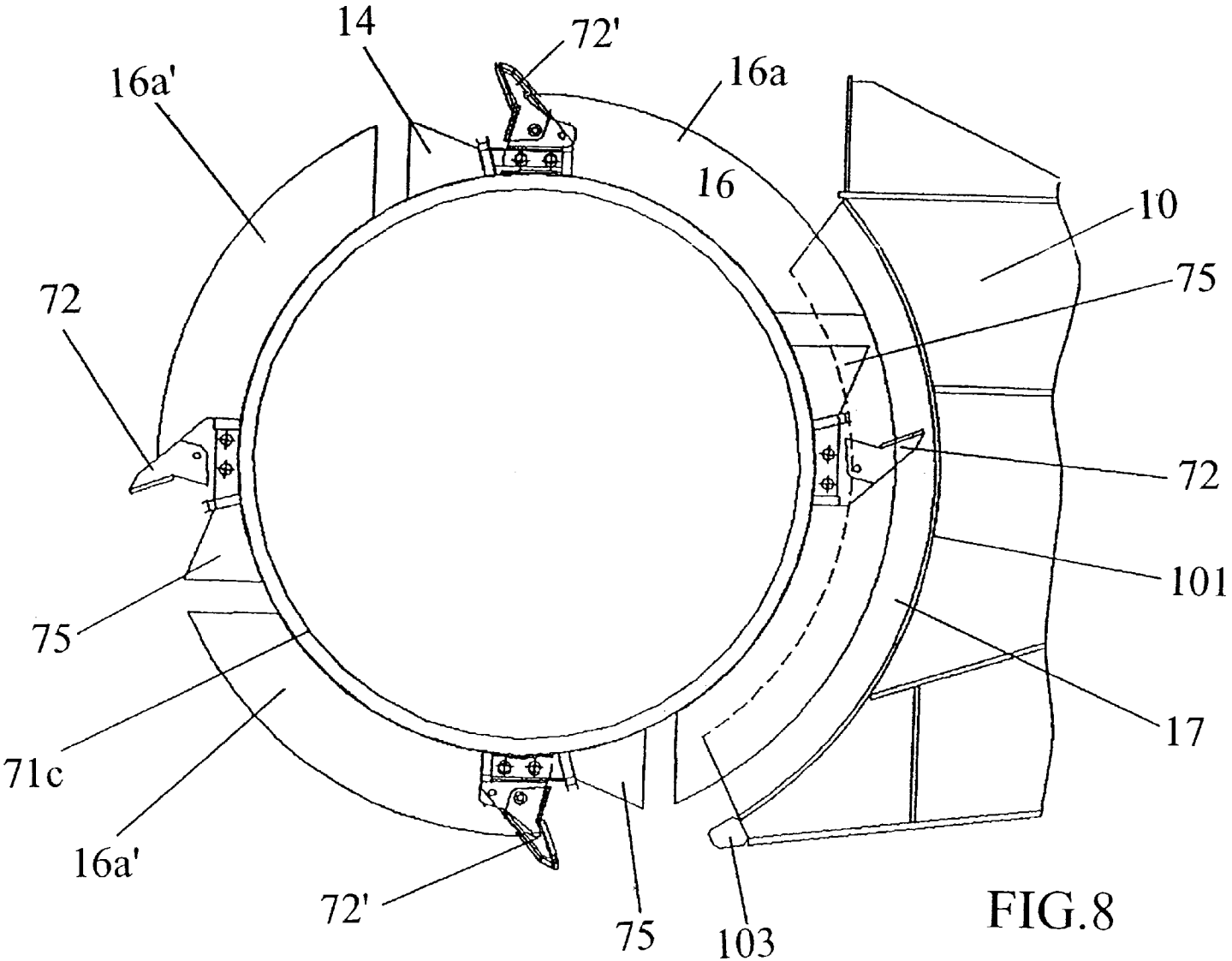
FIG. 8 is a sectional side view of the milling roller with the takeup chute shown partially.
Figure 9:
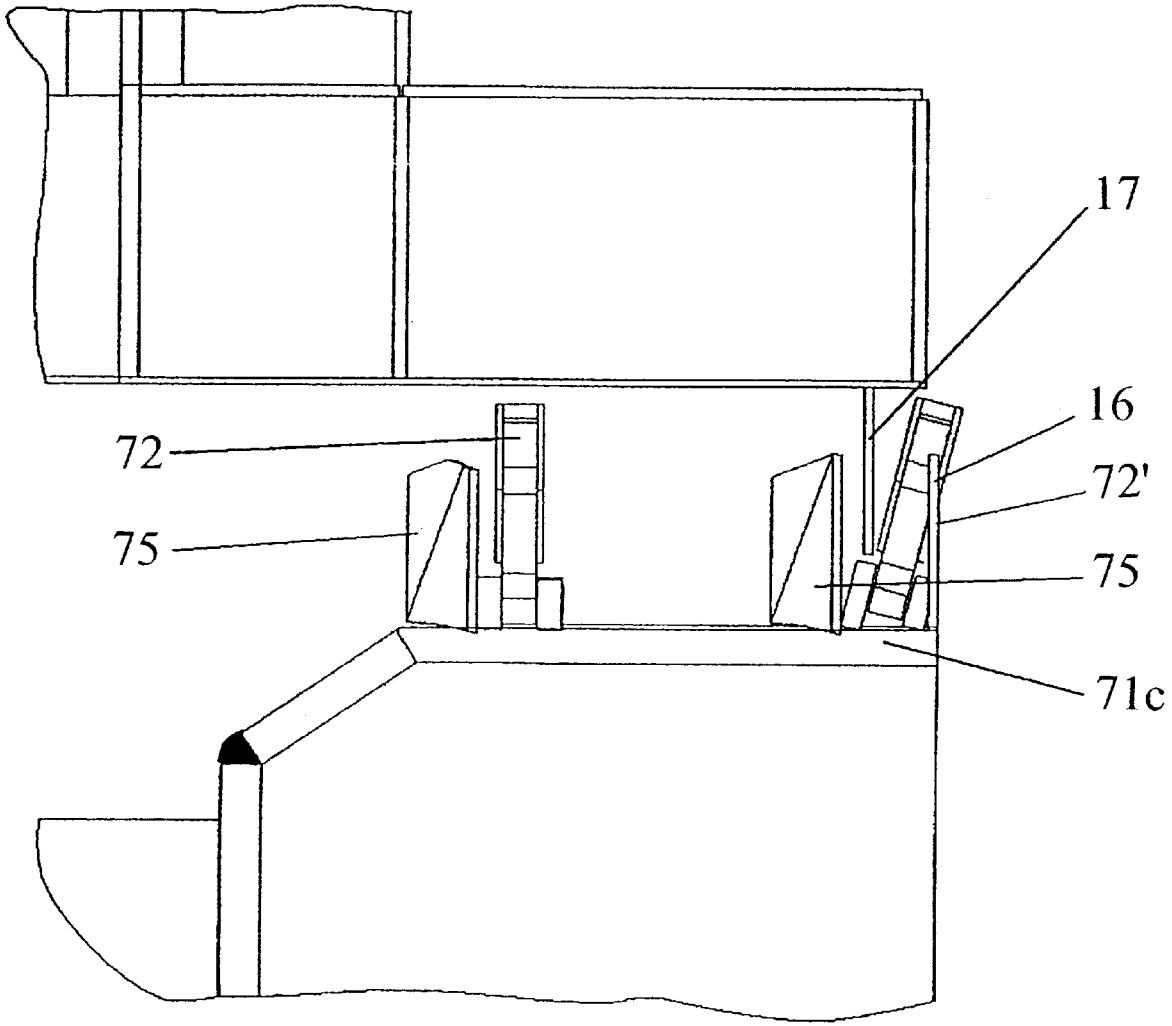
FIG. 9 is a sectional top view of a detail of a milling roller side and of a takeup chute side

Since the material tends to escape the four milling tools 72 on both sides after it has been loosened by the outer milling tools 72 intended for the free cut from the block being mined before it is caught by the next milling tools 72 and the helical guide plates 75, closing rings 16, whose external diameter is smaller than the cutting circle diameter $D_S$ of the milling tools 72, are arranged according to FIGS. 8 and 9 at the two ends of the milling roller 7 on its milling roller jacket 71. These closing rings 16 comprise individual segments 16*a*, which begin behind the two milling tools 72' intended for the free cut and extend to the guide plate 75, which belongs to the next milling tool 72. This variant is shown on the right-hand half of the milling roller in the representation according to FIG. 8. In a second variant, which is shown on the left-hand half of the milling roller in the same representation, these segments 16*a* are again divided into subsegments 16*a'* for better removal of the material in the direction of the center of the miner and their ends are bent inward as side buckets, as is shown in the representation according to FIG. 5. One closing ring segment 17 each, which extends over the entire height of the shield 101 and whose internal diameter is larger than the milling roller jacket 71, is likewise arranged in parallel to these closing rings 16 in the two outer areas of the takeup chute 10. One closing ring segment 17 each, which belongs to the takeup chute 10, and a closing ring 16 belonging to the milling roller 7 and comprising segments 16*a* or subsegments 16*a*' together form a labyrinth-like closure. Due to this design of the lateral closure of the annular conveying space for the material in the area of the milling roller 7, only a very small percentage of the material can escape the block being mined after loosening. The losses on conveying are thus substantially reduced.

While a specific embodiment of the invention has been shown and described in detail to illustrate the application of the principles of the invention, it will be understood that the invention may be embodied otherwise without departing from such principles.

What is claimed is:

1. A milling roller module for a surface miner, the milling roller module comprising:

a milling roller operating with undershot and having a milling roller jacket;

first and second drives for the milling roller;

a downstream discharge belt;

material guiding elements arranged between said milling roller and said downstream discharge belt;

a fastening structure for fastening said milling roller to a front of a chassis of the surface miner at right angles to a direction of travel in its horizontal longitudinal axis, said fastening structure including a support frame, said horizontal longitudinal axis also being the axis of rotation of said milling roller, said milling roller being mounted and driven by said first and second drives on both sides in an area of end faces of said milling roller, said milling roller having milling tools and guide plates arranged on a circumferential surface of said milling roller, wherein material being loosened from the block being mined is carried in a direction of rotation and is transferred to said discharge belt, said discharge belt being narrower than a cutting width of said milling roller, wherein a conveying space of the loosened material in the area of said milling roller is an annular space between said milling roller jacket and a cutting circuit diameter ($D_S$), a basic body of said milling roller being said milling roller jacket and completely accommodating said first and second drives each on one of sides of said milling roller, said first and second drives having power take-off shafts connected to said milling roller with a fixed drive housing connected to said support frame, and said first and second drives having bearings which are also the bearings of the said milling roller;

a takeup chute surrounding a portion of said milling roller at a spaced location from a cutting circle diameter ($D_S$) of said milling roller from a top edge of the level being cut in the direction of rotation of the roller in an angle of about 110°, said takeup chute limiting a conveying space for loosened material to an outside and being provided with a guide tunnel in an area of the intended transfer of the material to said discharge belt, said takeup chute being provided downstream of the block being mined in the direction of rotation of said milling roller to guide material and to transfer it to said downstream discharge belt in a specific manner, said takeup chute being connected to the surface miner with one upper joint and two longitudinally adjustable struts.

2. The milling roller module for a surface miner in accordance with claim 1, wherein said milling roller jacket is tubular and open on the side and comprises a broad middle pipe having a defined diameter ($D_1$) and two shorter, outer pipes of a larger diameter ($D_2$), said middle pipe being provided at two circular outer sides with a flange each, said flange having an internal diameter that is smaller than an internal diameter of the said middle pipe, an oblique transition each is provided between one of said lateral pipes and the associated said flange, and an enlargement of space, which is adapted to the amount of material to be actually conveyed, is thus formed between said cutting circle diameter ($D_S$) and said external diameters ($D_1$ and $D_2$) of said milling roller jacket from the outer areas toward the middle area, and said encapsulated drives are arranged in the interior of said milling roller jacket on both sides in said longitudinal axis and axis of rotation of said milling roller, wherein each of said first and second drives comprise a motor with a fixed housing part and a transmission unit with a power take-off shaft, wherein a fixed housing part and said rotating power take-off shaft are provided with a flange and two flanges of said power take-off shaft are connected axially to one of said flanges of said milling roller and each of said two flanges of said fixed housing part of said motor is connected to a free end of said support frame, which is likewise provided with a flange, and connection lines are provided for said first and second drives and are led to said first and second drives within a profile of said support frame.

3. The milling roller module for a surface miner in accordance with claim 1, wherein the support frame includes a horizontal middle beam arranged on a superstructure of said surface miner and two vertical side members detachably connected to said middle beam with vertical surfaces facing each other and bolt joints with centering means, and guide pipes, which extend on the right and left into the area of said two side members and are surrounded by sliding pipes fastened in said two side members in an area of said two side members and provided as assembly aids in said horizontal middle beam, and said two side members are bent twice at a bottom such that they extend with their flanges into said milling roller in an upper radius of said milling roller.

4. The milling roller module for a surface miner in accordance with claim 1, wherein:

a shield surrounds said milling roller on a side opposite the block being mined at a spaced location from said cutting circle diameter ($D_S$) over the entire milling width and in the height from the level in the upward direction in an angle of about 110°;

a lower edge of said shield is provided with a wear edge, which comprises interchangeable segments;

said shield is reinforced on its rear side with a carrying and support structure;

said takeup chute is connected to said superstructure at a top in parallel to said axis of rotation of said milling roller in a joint and it is connected to said superstructure at the bottom by a right and left double joint each by means of a strut each acting as an adapter, and an opening designed as a guide tunnel for the material is provided in said takeup chute in a flight parabola of the material for transferring the material onto said discharge belt.

5. The milling roller module for a surface miner in accordance with claim 1, wherein the annular conveying space for the loosened material is limited laterally by a right and left closing ring, wherein each of said closing rings comprises segments arranged at an edge of said roller and extends from a back of said milling tool intended for the free cut to a beginning of said helical guide plate of the next milling tool for the free cut in the direction of rotation of the roller, and said segments may be once again divided over their length into subsegments, whose ends are bent inward as side buckets, and the external diameter of said closing ring is smaller than said cutting circle diameter ($D_S$) of said milling tools, and an additional closing ring segment each, whose internal diameter is larger than said milling roller jacket, is arranged at said takeup chute in the two outer areas on the arc-shaped side directed toward said milling roller over its entire height in parallel to said closing rings comprising said segments or subsegments inside on the side of the middle of the miner, and said closing ring of said milling roller to form a closure in the form of a simple labyrinth together with said closing ring segment of said takeup chute on each of two sides.

6. The milling roller module for a surface miner in accordance with claim 1, wherein milling bits of equal size are used with bit holders made so large that the tips of all said milling bits form a common cutting circle diameter $D_S$ despite said different diameters $D_1$ and $D_2$ of said milling roller jacket.

* * * * *